US009210514B2

(12) United States Patent
Akino

(10) Patent No.: US 9,210,514 B2
(45) Date of Patent: Dec. 8, 2015

(54) THROAT MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/505,897

(22) Filed: Oct. 3, 2014

(65) Prior Publication Data

US 2015/0110301 A1 Apr. 23, 2015

(30) Foreign Application Priority Data

Oct. 17, 2013 (JP) ..... 2013-215986

(51) Int. Cl.

| | |
|---|---|
| ***H04R 25/00*** | (2006.01) |
| ***H04R 17/02*** | (2006.01) |
| ***H04R 1/42*** | (2006.01) |
| ***H04R 1/14*** | (2006.01) |
| *H04R 17/00* | (2006.01) |
| *H04R 7/26* | (2006.01) |

(52) U.S. Cl.

CPC ..... *H04R 17/02* (2013.01); *H04R 1/14* (2013.01); *H04R 1/42* (2013.01); *H04R 7/26* (2013.01); *H04R 17/00* (2013.01)

(58) Field of Classification Search

USPC ..... 381/190

See application file for complete search history.

(56) References Cited

U.S. PATENT DOCUMENTS

| | | | | |
|---|---|---|---|---|
| 3,181,016 | A * | 4/1965 | Rosenman | 310/332 |
| 4,596,903 | A * | 6/1986 | Yoshizawa | G01H 11/08 367/166 |
| 5,406,848 | A * | 4/1995 | Okada | 73/514.32 |
| 5,991,424 | A * | 11/1999 | Bertagni et al. | 381/397 |
| 8,798,298 | B1 * | 8/2014 | Burns et al. | 381/318 |

FOREIGN PATENT DOCUMENTS

| | | | |
|---|---|---|---|
| JP | 6349018 | Y2 | 12/1988 |
| JP | 10079999 | A | 3/1998 |
| JP | 2012-231204 | A | 11/2012 |

* cited by examiner

*Primary Examiner* — Davetta W Goins
*Assistant Examiner* — Amir Etesam
(74) *Attorney, Agent, or Firm* — Whitham Curtis Christofferson & Cook, PC

(57) ABSTRACT

A throat microphone includes a cantilevered piezoelectric device 1 having a fixed end 11 supported by a base 3 and a free end with an anchor 4 fixed thereto. The piezoelectric device 1 vibrates to output audio signals in response to vibrations of a throat. The fixed end is attached to the base 3 such that the piezoelectric device 1 vibrates parallel to the surface of the base 3. A gap is defined between the anchor 4 and the base 3. The gap is provided with a vibration absorber 5.

12 Claims, 4 Drawing Sheets

THROAT MICROPHONE

TECHNICAL FIELD

The present invention relates to a throat microphone including a cantilevered piezoelectric device for converting vibrations of a throat into audio signals.

BACKGROUND ART

Throat microphones, which convert vibrations of throats into audio signals, have an advantage in that they can precisely convert human voices into audio signals even in noisy environments. A typical throat microphone includes an acoustoelectric transducer consisting of a piezoelectric device. Such a transducer of the throat microphone generally includes a compact piezoelectric bimorph that can output high levels of signals in response to displacement.

FIGS. 3 and 4 illustrate a technology on a throat microphone including a piezoelectric bimorph. In the drawings, a piezoelectric device 50 consisting of a piezoelectric bimorph has a fixed end 51. The fixed end 51 is embedded in a stationary part 62 that protrudes from a base 63. The piezoelectric device 50 is cantilevered in such a manner that the piezoelectric device 50 extends parallel to a surface of the base 63 and can vibrate perpendicular to the surface of the base 63.

The piezoelectric device 50 consisting of a piezoelectric bimorph produces electrical signals in proportion to vibrational displacements. The piezoelectric device 50, which outputs signals proportional to the displacements, is called "displacement-proportional device". The piezoelectric device 50 is deformed by external force and resiliently returns to its original shape when the force disappears. In other words, the piezoelectric device 50 is deformed by acceleration input and output signals. Such a piezoelectric device 50 is called "stiffness control device". As shown in FIGS. 3 and 4, the piezoelectric device 50 has a free end 52 provided with an anchor 64 fixed thereto, so that the piezoelectric device 50 can efficiently respond to vibrational acceleration.

A throat microphone is designed to have a resonant frequency equal to the upper limit of the frequency band of the collected sound. Such a design equalizes the frequency response of the output signals corresponding to acceleration applied to the piezoelectric device 50 in the throat microphone. Since the throat microphone detects the vibrational acceleration from the throat with a piezoelectric element, the piezoelectric device 50 has a resonant frequency of 3-4 kHz which is equal to the upper limit of the frequency band of the collected sound. The resonant frequency of the piezoelectric device 50 depends on the stiffness of the piezoelectric device 50 and the mass of the anchor 64. For the piezoelectric device 50 (which is of a stiffness control type) with a constant stiffness, the resonant frequency decreases and the sensitivity to the acceleration increases in proportion to the mass of the anchor 64. Such relation between the anchor 64 and the resonant frequency and sensitivity is disclosed in Japanese Unexamined Patent Application Publication No.2012-231204.

Since the piezoelectric device 50 is designed to have a resonant frequency of 3-4 kHz as described above, the throat microphone produces audio signals with high clarity at high sensitivity to the vibrational acceleration from the throat within the audio frequency band. The frequency response at the resonant frequency depends greatly on the sharpness of the resonance (Q).

The device of FIGS. 3 and 4 includes a low-resilience silicone viscoelastic rubber piece 65 between the base 63 and the piezoelectric device 50. The viscoelastic rubber piece 65 attenuates the vibrations of the vibration system. As such, the traditional structure (FIGS. 3 and 4) is provided with the viscoelastic rubber piece 65 to decrease the sharpness of resonance (Q) and sensitivity (at the resonant frequency) of the piezoelectric device 50, aiming at collecting high-quality audio signals even in noisy environments. The structures in Japanese Examined Utility Model Application Publication No. S63-49018 and Japanese examined Patent Application H4-32599 each include a hermetically-sealed container loaded with a piezoelectric device and a viscous liquid damper. These structures are aimed at decreasing the sharpness of the resonance of the piezoelectric device 50, like the structure in FIGS. 3 and 4.

The viscoelastic rubber piece 65 of the device of FIGS. 3 and 4 is prone to variations in contact, i.e., mechanical coupling to the surfaces of the base 63 and the piezoelectric device 50. Such variations lead to a difference in vibration propagation to the piezoelectric device 50 among finished products in the structure shown in FIGS. 3 and 4. To address such a situation, the vibration system in FIGS. 3 and 4 is entirely covered with a sealant 66 of room-temperature vulcanizing (RTV) rubber to improve the mechanical coupling between the base 63 and the piezoelectric device 50. Unfortunately, the sealant 66 covering the overall vibration system in FIGS. 3 and 4 cannot readily reduce a difference in vibration propagation to the piezoelectric device 50 among the finished products.

In FIGS. 3 and 4, the piezoelectric device 50 outputs audio signals through lead connections 67 and leads 68.

Japanese Unexamined Patent Application Publication No. H10-79999 evidentially shows that a piezoelectric device in a conventional throat microphone vibrates perpendicular to a surface of the base.

SUMMARY OF INVENTION

Technical Problem

An object of the present invention, which has been made to solve technical problems in traditional throat microphones, is to provide a throat microphone with a cantilevered piezoelectric device exhibiting a sharpness of resonance without variations among the finished products.

Solution to Problem

The main feature of the present invention is a throat microphone that includes a cantilevered piezoelectric device having a fixed end supported by a base and a free end with an anchor fixed thereto, and vibrating in response to vibrations of a throat to output audio signals. The end is fixed to the base such that the piezoelectric device vibrates parallel to the surface of the base. A gap is defined between the anchor and the base. The gap contains a vibration absorber.

Advantageous Effects of Invention

According to the present invention, the piezoelectric device vibrates parallel to a surface of the base. This can reduce the distance between the vibrating surface of the piezoelectric device and the surface of the base, and thus the gap between the anchor and the base. The vibration absorber in the gap leads to stable resonance sharpness of the piezoelectric device, preventing variations in resonance sharpness among the finished products.

DESCRIPTION OF EMBODIMENTS

Embodiments of a throat microphone of the present invention will now be described with reference to the attached drawings.

Embodiments

Figure 1:
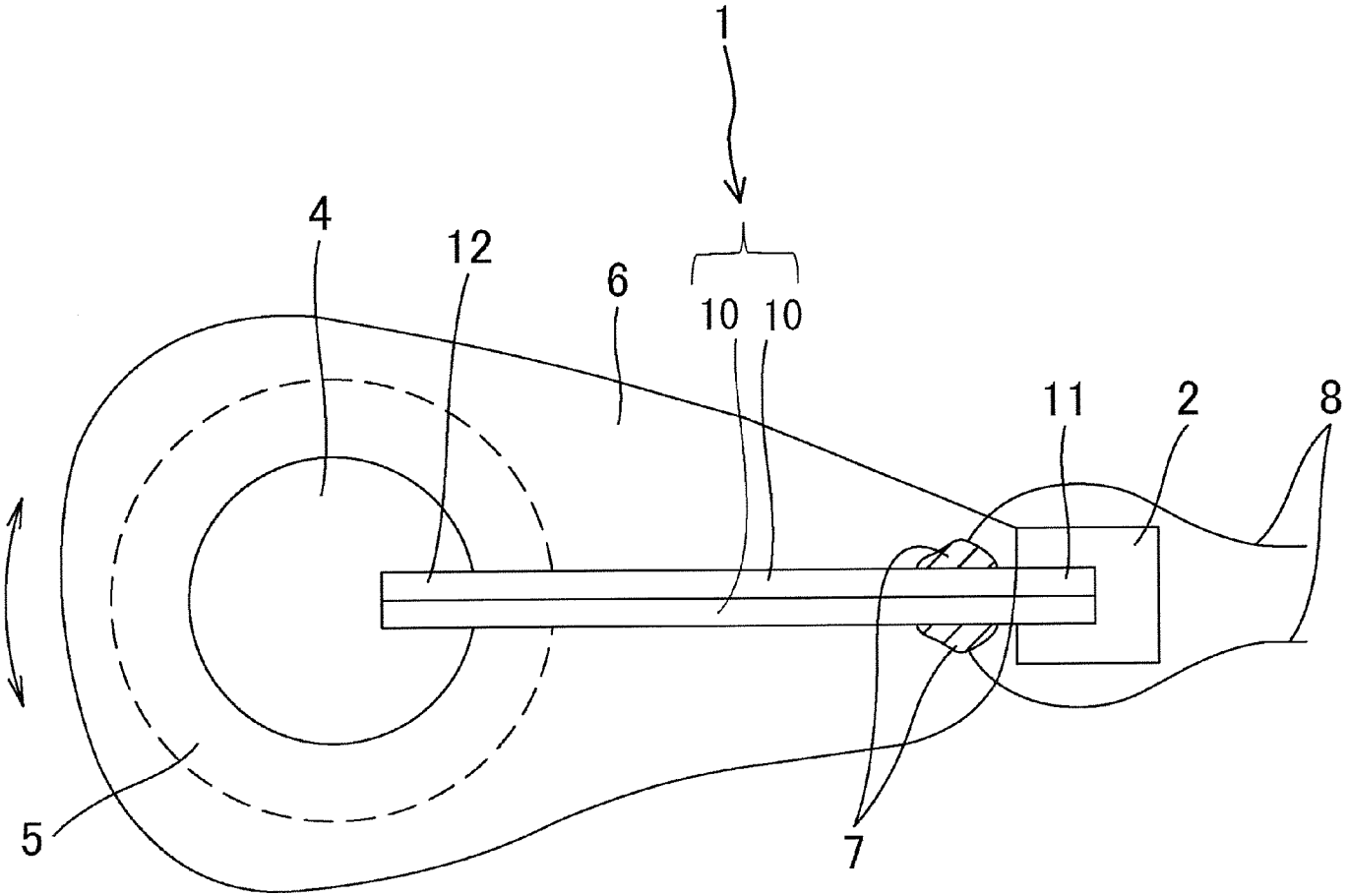
FIG. 1 is a plan view illustrating a throat microphone of an embodiment of the present invention.
Figure 2:
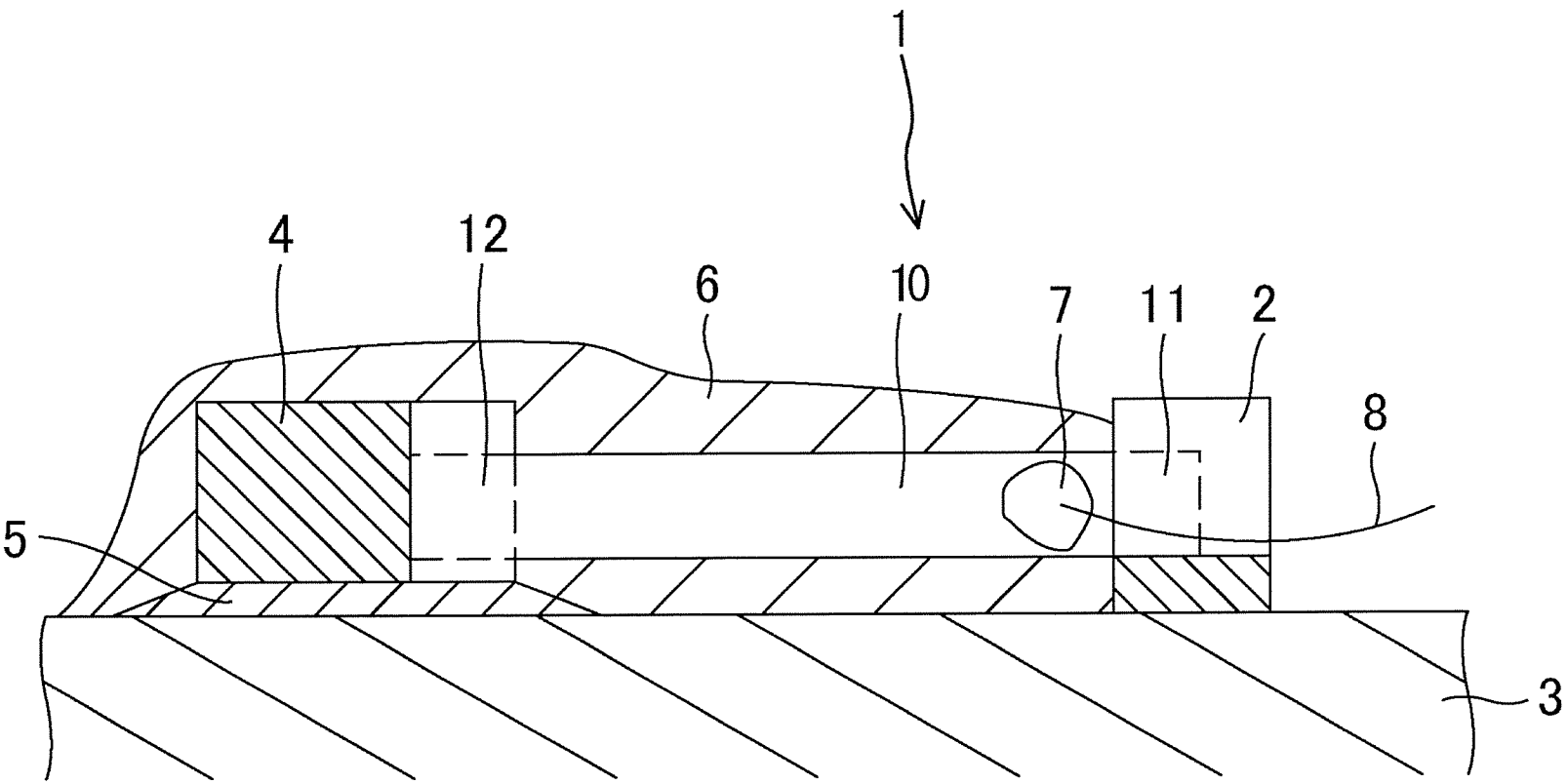
FIG. 2 is a front cross-sectional view of the throat microphone.
Figure 3:
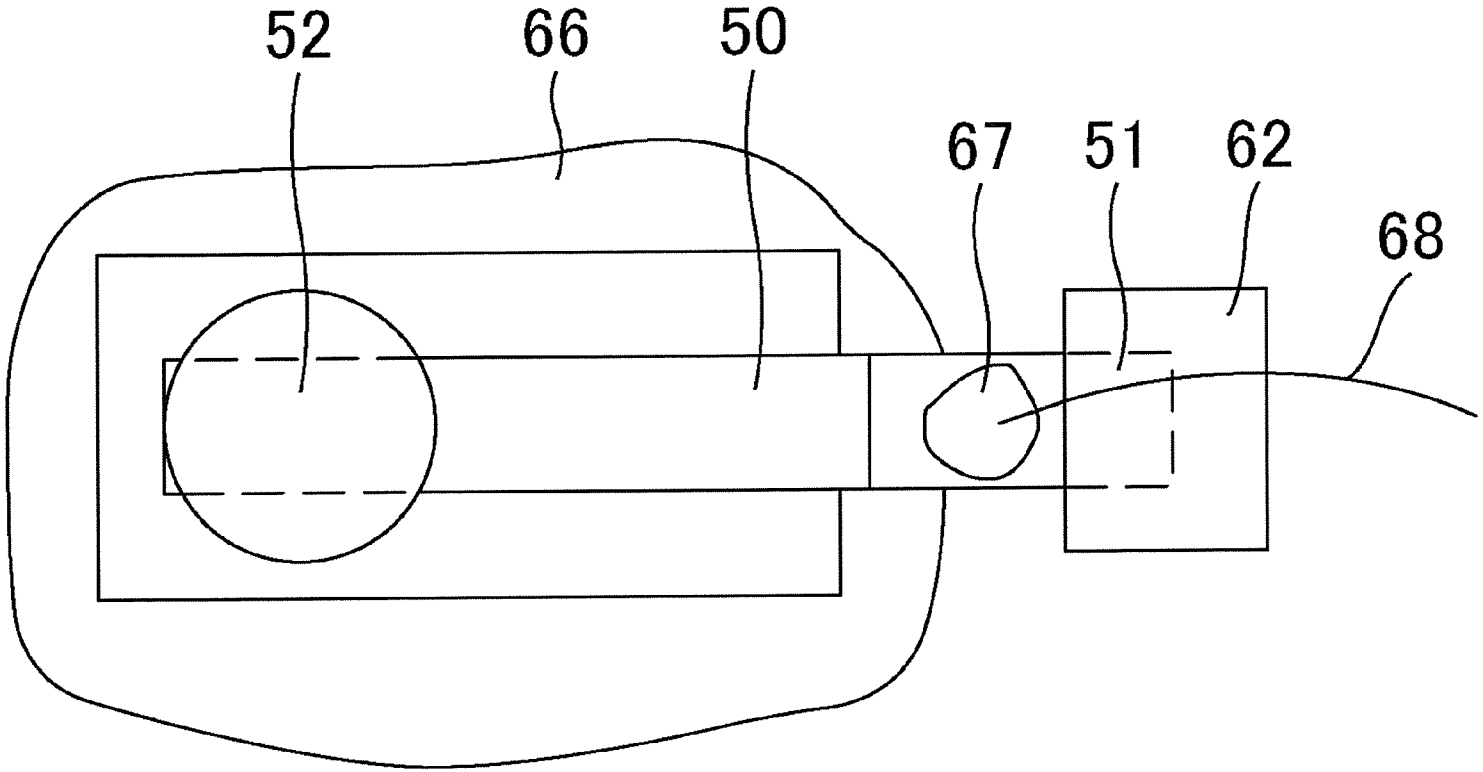
FIG. 3 (Related Art)
FIG. 3 is a plan view illustrating traditional technology on a throat microphone.
Figure 4:
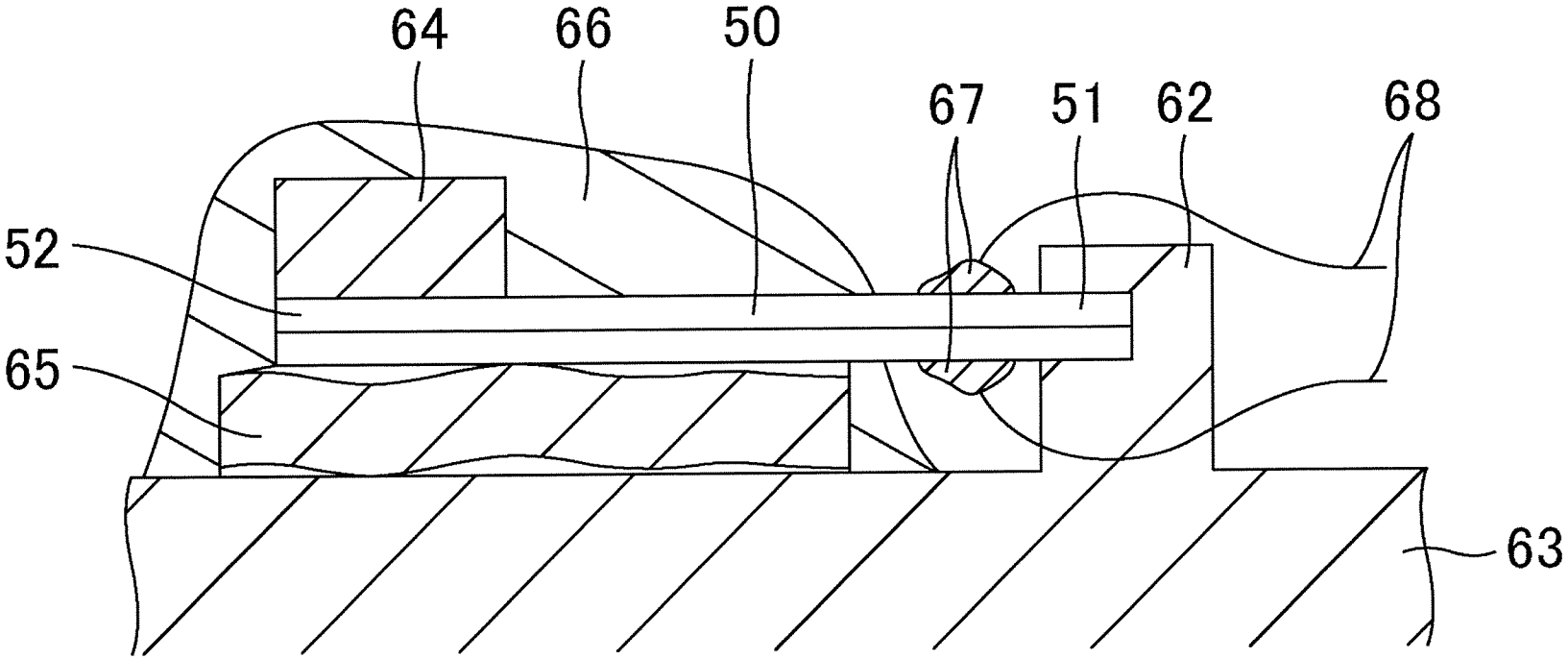
FIG. 4 (Related Art)
FIG. 4 is a front cross-sectional view of the traditional technology.

FIGS. 1 and 2 illustrate a piezoelectric device 1 that is a piezoelectric bimorph consisting of two plate piezoelectric elements 10 bonded to each other. The output of the piezoelectric device 1 is the sum of signals from these two piezoelectric elements 10. The piezoelectric device 1 has a fixed end 11. The fixed end 11 is embedded to a stationary member 2 integrated with a base 3. Thus, the fixed end 11 of the piezoelectric device 1 is substantially fixed or integrated with the base 3, so that the piezoelectric device 1 is cantilevered.

The piezoelectric device 1 extends from the stationary member 2 parallel to a surface of the base 3, with a predetermined distance from the base 3. The piezoelectric device 1, which is resilient, can vibrate with the end 11 as a support in response to vibrations applied thereto. The end 11 is fixed to the stationary member 2 such that the piezoelectric device 1 vibrates parallel to the surface of the base 3. In other words, the piezoelectric device 1 is fixed such that surfaces of the two piezoelectric elements 10, i.e., the bonded surfaces of the piezoelectric element 10 are perpendicular to the surface of the base 3.

The piezoelectric device 1 has a free end 12 provided with an anchor 4 fixed thereto. The anchor 4 is a short cylinder, for example. The surface of the cylinder has a groove partially provided parallel to the central axis of the anchor 4. The tip 12 of the piezoelectric device 1 is fitted in the groove, so that the anchor 4 is fixed to the piezoelectric device 1. The length of the anchor 4 along its central axis is larger than the width of the piezoelectric device 1 along the vertical direction in FIG. 2. The anchor 4 has a circular bottom surface below the bottom surface of the piezoelectric device 1. The bottom surface of the anchor 4 is parallel to the surface of the base 3. The bottom surface of the anchor 4 is also adjacent to the base 3 with a gap between the anchor 4 and the base 3. The gap has a size allowing a liquid to flow in it by capillary action.

The gap between the anchor 4 and the base 3 is filled with a vibration absorber 5. The vibration absorber 5 is a viscous liquid, for example, a silicone oil. The gap between the anchor 4 and the base 3 has a size allowing the silicone oil to flow in it by capillary action, but does not adversely affect the vibration of the piezoelectric device 1 in the direction parallel to the surface of the base 3.

To define a gap with high dimensional accuracy between the anchor 4 and the base 3 such that the silicone oil can flow in it by capillary action, the following process is preferably employed. A film is provided between the anchor 4 and the base 3 to leave a gap corresponding to the thickness of the film between the anchor 4 and the base 3. The anchor 4 is bonded to the piezoelectric device 1 with an adhesive. The film is removed after the adhesive is cured. Thus, a uniform gap corresponding to the thickness of the film is defined between the anchor 4 and the base 3. A viscous liquid, for example, a silicone oil entering the gap provides a uniform mechanical resistance between the anchor 4 and the base 3.

The mechanical resistance between the anchor 4 and the base 3 depends on the size of the gap, the overlapping area between the anchor 4 and the base 3, and the viscosity of the vibration absorber 5. The width of the gap depends on the thickness of the film, which is determined as appropriate to define such a gap. Setting the thickness of the film to an appropriate value yields an appropriate mechanical resistance. The thickness of the film is appropriately determined within a range of 0.05 to 0.2 mm, for example.

A silicone oil (the vibration absorber 5) is injected into the gap. An appropriate amount of silicone oil then flows in the gap by capillary action. The silicone oil (the vibration absorber 5) between the anchor 4 and the base 3 attenuates the vibration of the piezoelectric device 1. This leads to a reduction in the sharpness of the resonance of the throat microphone, decreasing the sensitivity at the resonant frequency. Thus, the throat microphone of this embodiment can collect high-quality sounds even in noisy environments. A silicone oil (the vibration absorber 5) has an invariable viscosity even at variable temperatures.

Referring to FIGS. 1 and 2, a vibration system including the piezoelectric device 1, the anchor 4, and the vibration absorber 5 is sealed with a sealant 6 on the surface of the base 3. The sealant 6 is formed of RTV rubber. Since the piezoelectric device 1 consisting of the piezoelectric bimorph is sealed with the sealant 6 on the base 3, the piezoelectric bimorph can be protected from mechanical damage due to excess impact force applied thereto. In the throat microphone of this embodiment, the vibration absorber 5 of a viscous liquid is also sealed with the sealant 6 and thus does not leak. The sealant 6 of RTV rubber does not inhibit the vibration of the piezoelectric device 1 in response to vibrations of the throat.

In FIGS. 1 and 2, the piezoelectric device 1 outputs audio signals through lead connectors 7 and leads 8.

The component shown in FIGS. 1 and 2 corresponds to a microphone unit of the throat microphone. The throat microphone is composed of the microphone unit of FIGS. 1 and 2 appropriately mated or mounted to a wearing unit, such as a wearing belt. The user wears the wearing unit together with the microphone unit in a predetermined manner, and the microphone unit is put against a predetermined point of the user's throat. The microphone unit can thereby convert vibrations of the user's throat into audio signals.

The invention claimed is:

1. A throat microphone comprising:

a base having a flat surface; and a cantilevered piezoelectric device having a fixed end supported by the base, wherein the piezoelectric device has a free end with an anchor attached thereto and outputs audio signals in response to vibrations of a throat, the fixed end is fixed to the base and is spaced away from the flat surface of the base so that the piezoelectric device vibrates parallel to the flat surface of the base, the anchor and the flat surface of the base are separated by a gap without the anchor touching the flat surface of the base, and a vibration absorber positioned in the gap and extending between the anchor and the flat surface of the base.

2. The throat microphone of claim 1, wherein the piezoelectric device, the anchor, and the vibration absorber are sealed with a sealant on the surface of the base.

3. The throat microphone of claim 1, wherein the piezoelectric device is a piezoelectric bimorph.

4. The throat microphone of claim 1, wherein the vibration absorber is a viscous liquid.

5. The throat microphone of claim 4, wherein the viscous liquid is a silicone oil.

6. The throat microphone of claim 1, wherein the anchor has a surface parallel to the surface of the base.

7. The throat microphone of claim 4, wherein the gap between the anchor and the surface of the bas has a size allowing the viscous liquid to flow in by capillary action.

8. The throat microphone of claim 2, wherein the sealant comprises RTV rubber.

9. The throat microphone of claim 1 wherein said gap ranges from 0.05 to 0.2 mm.

10. The throat microphone of claim 9 wherein the vibration absorber is a viscous liquid, and wherein the piezoelectric device, the anchor, and the viscous liquid are sealed with a sealant on the surface of the base.

11. The throat microphone of claim 7 wherein said gap ranges from 0.05 to 0.2 mm.

12. The throat microphone of claim 3 where the piezoelectric biomorph includes bonded surfaces of piezoelectric elements which are perpendicular to the surface of the base.

* * * * *